US005971154A

United States Patent [19]

Toren

[11] Patent Number: 5,971,154

[45] Date of Patent: Oct. 26, 1999

[54] DISPENSING CONTAINERS

[75] Inventor: Thomas Toren, New South Wales, Australia

[73] Assignee: Toren Consulting Pty, . Ltd., Australia

[21] Appl. No.: 09/234,214

[22] Filed: Jan. 20, 1999

[51] Int. Cl.[6] ..... B65D 83/04

[52] U.S. Cl. ..... 206/534; 206/540; 221/306; 222/545

[58] Field of Search ..... 206/459.1, 528, 206/534, 540, 807; 215/203, 206; 221/266, 277, 281, 282, 287, 288, 303, 306; 222/48, 363, 513, 519–521, 531, 545, 562

[56] References Cited

U.S. PATENT DOCUMENTS

| | | | |
|---|---|---|---|
| 3,313,441 | 4/1967 | Fadden | 206/540 |
| 3,860,111 | 1/1975 | Thompson | 206/534 |
| 3,874,564 | 4/1975 | Huneke . | |
| 3,889,847 | 6/1975 | Uroshevich et al. | 206/540 |
| 4,164,301 | 8/1979 | Thayer | 206/534 |
| 4,380,307 | 4/1983 | Stillinger . | |
| 4,613,057 | 9/1986 | Sacchetti et al. | 221/288 |
| 5,383,559 | 1/1995 | Toren | 206/528 |

*Primary Examiner*—Jim Foster
*Attorney, Agent, or Firm*—Gregory M. Howison

[57] ABSTRACT

A dispensing container for medicinal or food supplement tablets, capsules or other similarly shaped products, or granular, powder or liquid products, said container having a hollow body (101) closed at one end (122) and an aperture (106) at the other end and two external dispensing means (102, 110) movable in relation to said hollow body (101) and each other, said external dispensing means (102, 110) being attached to said other end of said hollow body so as to prevent them from being removed, said two external dispensing means (102, 110) having dispensing apertures or cut-outs (107, 115) that can either be aligned with said aperture (106) in said hollow body (101) by moving each one of said external dispensing means (102, 110) in relation to said hollow body (101), in order to enable the dispensing of said product or, alternatively, be misaligned with said aperture (106) in said hollow body (101) by moving either one of said external dispensing means (102, 110) in relation to said hollow body (101), in order to prevent the dispensing of said product, and means to move said two external dispensing means (102, 110) and said hollow body (101) in relation to each other in order to align and misalign said dispensing apertures or cut-outs (107, 115) with said aperture (106).

14 Claims, 4 Drawing Sheets

DISPENSING CONTAINERS

TECHNICAL FIELD

This invention concerns a dispensing container having a hollow body to store product and a dispensing port that is selectively opened to dispense product from the hollow body.

BACKGROUND ART

Most child resistant packaging closures currently on the market, especially those used for medical and health care tablet and capsule containers and bottles, as well as those used for cosmetic products, household cleaning products, gardening and other household substances, are too difficult to open and close for elderly people, particularly those people who suffer from weak and arthritic hands. Consequently, there is a tendency by elderly people not to close these child resistant packages properly or to leave the caps off completely or even to transfer the contents, such as tablets, into containers or bottles that are not child resistant. The American publication 'Packaging Strategies' reported that "a 1983 study by the American Association of Poison Control Centers for the United States Consumer Product Safety Commission found that 82% of child poisoning exposures involving prescription drugs takes place in the child's home and involves medications that do not belong to anyone living in the home (often a visiting grandparent). The study found that seniors often do not or cannot use child resistant packs for their medications. This is at the heart of Consumer Product Safety Commission's new senior friendly child resistant packaging test requirements."

In order to make packaging both resistant to young children and easy to access by elderly people, it is necessary to substitute force and dexterity for opening of closures with cognitive skills that are within the ability of elderly people and yet beyond the capability of young children.

The dispensing container for tablets which is the subject of the International Application No. PCT/AU91/00233 (International Publication No. 91/18808), the U.S. Pat. No. 5,383,559 and the European Patent No. 0531394, all with priority of expired Australian Provisional Patent Application No. PK 0484 of Jun. 4 1990 (same applicant and inventor as for the present patent application), has an inherent feature that makes it easy to use for elderly people, namely that the closure does not have to be removed and replaced in order to dispense one or more tablets or capsules. Turning the closure in relation to the container to align the dispensing apertures in the closure and the container is much easier than removing and replacing any of the conventional child resistant closures such as, for instance, the widely used closure that has to be simultaneously pressed down and unscrewed. Replacing either child resistant or even non child resistant, conventional screw caps is particularly difficult for elderly people and people with arthritic hands because the threads in the cap and on the container have to be co-axially aligned for the threads to engage.

It is generally difficult to achieve a design that is convenient for use by elderly people and at the same time resistant to access by children.

SUMMARY OF THE INVENTION

This invention is a dispensing container having a hollow body to store product and a dispensing port that is selectively opened to dispense product from the hollow body. The dispensing port includes first, second and third apertured plates, the first plate being furthest from the hollow body, the three plates being moveable relative to each other to open the port when the apertures of the three plates are aligned, and otherwise to close the port First formations are cooperable between the first and second apertured plates to allow movement of the first plate relative to the second plate within a predetermined range and to constrain the second plate to move with the first plate when the first plate is moved outside of the predetermined range.

Second formations may be cooperable between the second plate and the third plate to allow the second plate to move freely relative to the third plate when disengaged, and to prevent movement between the second and third plates during movement of the first plate within the predetermined range, when second formations are engaged. The second formations are engaged and disengaged by constrained movement of the second plate relative to the third plate caused by movement of the first plate.

The third plate may be fixed relative to the hollow body, the first plate may be a closure that is captive and moveable relative to the hollow body, and the second plate may be a washer that is tapped between the closure and the third plate.

The closure may be rotatable relative to the hollow body.

The first formations may include a stop of the closure and two stops of the washer.

The second formations may include one or two stops on the second plate and a stop on the third plate.

There may be indicia on the outer surfaces of said first plate and the hollow body to indicate their relative angular position. The indicia may comprise arrows and lines on the outsides of the closure and the container or bottle in such a position that when the closure is turned the collect amount in relation to the container or bottle and these arrows are lined up, the dispensing apertures are also aligned and thereby allow a tablet, capsule or other contents to pass through them.

The first and second plates may be individually accessible from the outside to enable their manual rotation in relation to each other and the hollow body.

The dispensing port may be opened by movement of the first plate in a first direction relative to the third plate, and then movement of the first plate in the opposite direction. It will be explained in more detail in the description of the preferred forms of this invention later in this specification that in order to align all three apertures, it may be necessary to turn the closure in relation to the container or bottle in a predetermined sequence, clockwise or anti-clockwise, until a particular stop is reached or until a particular arrow on the outside of the closure is lined up, visually or by feeling, with the arrow on the outside of the container or bottle. This predetermined sequential turning of the closure clockwise and anti-clockwise, the reaching of stops and the lining up of arrows is a cognitive skill that requires the reading of printed instructions accompanying the package and, consequently, is beyond the capability of young children.

Turning the closure the correct amount for the alignment of said arrows and lines requires more cognitive skill than, for instance, turning the closure until a pin reaches a stop, thus making the dispensing container of this invention resistant to children.

The hollow body may have the shape of a bottle.

When the dispensing container or bottle is used for tablets, caplets, capsules or similarly shaped products, the first plate may have an external receptacle enclosed on four sides. The function of the receptacle being to hold a tablet temporarily and permit its manual removal, as well as to make said tablet block the way for any other tablet from passing through the dispensing aperture until such time that said tablet has been removed.

When the dispensing container or bottle is used for granular, powder or liquid products, said receptacle is replaced by a pouring spout. For some applications the receptacle and spout may be omitted altogether.

When the dispensing container or bottle is used for tablets, caplets, capsules or similarly shaped products, an annular circumferential channel inside the hollow body adjacent the apertures may directionally orient the product as it is dispensed. When the dispensing container is used for granular, powder or liquid products, said annular circumferential channel is not required.

Embodiments of the present invention may provide a packaging container with features that make the dispensing container resistant to access by children and that make the dispensing container suitable for additional product applications, such as granular, powder and liquid products.

BRIEF DESCRIPTION OF THE DRAWINGS

Without restricting the full scope of this invention, four preferred forms of this invention will be described with reference to the following drawings.

BEST MODES OF THE INVENTION

Figure 4:
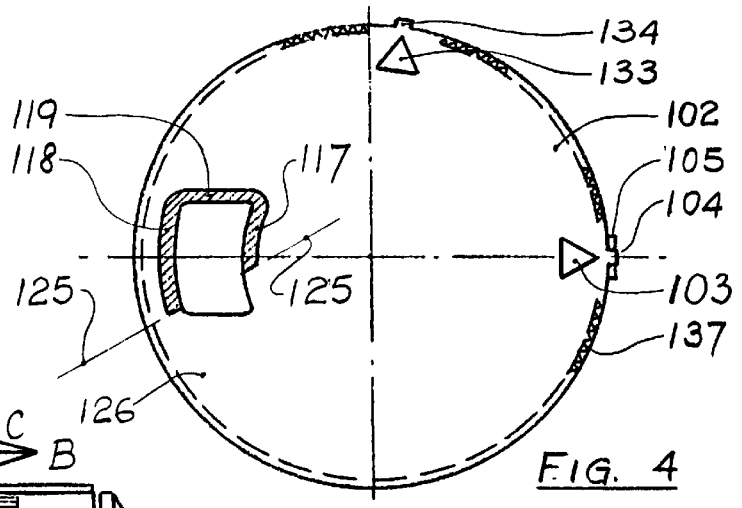
FIG. 4 is the section C—C through the receptacle and view of the closure in FIG. 2.

The first preferred form of this invention is shown in FIGS. 1, 2, 3, 4 and 5. The container has a hollow body 101, shown best in FIG. 1, that is closed at one end by plug 122 which is pressed into said container with an interference fit that will prevent its removal from said container by hand without the aid of tools, thus making it resistant to opening by small children.

At the other end the hollow body 101 has a cylindrical outer shape and an annular circumferential channel 121 inside. In dispensing containers for round or hexagonal tablets, the width of said channel corresponds to the width of the tablet and the depth of said channel is slightly greater than the diameter of said tablet. In dispensing containers for capsules and caplets the as width of said channel is such as to allow the capsules or caplets to lie inside said channel with their axis parallel to the base of said channel and the depth of said channel is slightly greater than the length of said capsules or caplets to be dispensed.

The dispensing port will now be described. A first plate comprising a captive closure 102 shown in FIGS. 1, 2, 3 and 4 is molded from a plastic polymer material and fits over the other end of hollow body 101. Ring 123 integral with the outer cylindrical end of said container fits into the internal annular groove 124 of said closure so that said closure is too difficult to remove from the container by hand without the use of tools and therefore impossible to remove for small children. This prevents small children from accessing all of the contents by removing the closure, as would be the case with conventional containers and bottles with removable closures. Said container can also incorporate an external ring 135 adjacent to said closure to further protect said closure from being forcibly pried off.

Located between said permanent closure 202 and hollow body 101 is a second plate comprising a substantially flat washer 110. The base of the channel 121 comprises a third plate. In the base of container channel 121 and in closure 102 are apertures 106 and 107 respectively and in washer 110 is a cut-out 115, all of which are just large enough for a round or hexagonal tablet to pass through when said two apertures and said cut-out are aligned. When capsules or caplets are being dispensed, the length of said two apertures and of said cut-out are greater than half the length of the capsule or caplet to assist a capsule or caplet to drop out through said aligned apertures and cut-out.

Figure 1:
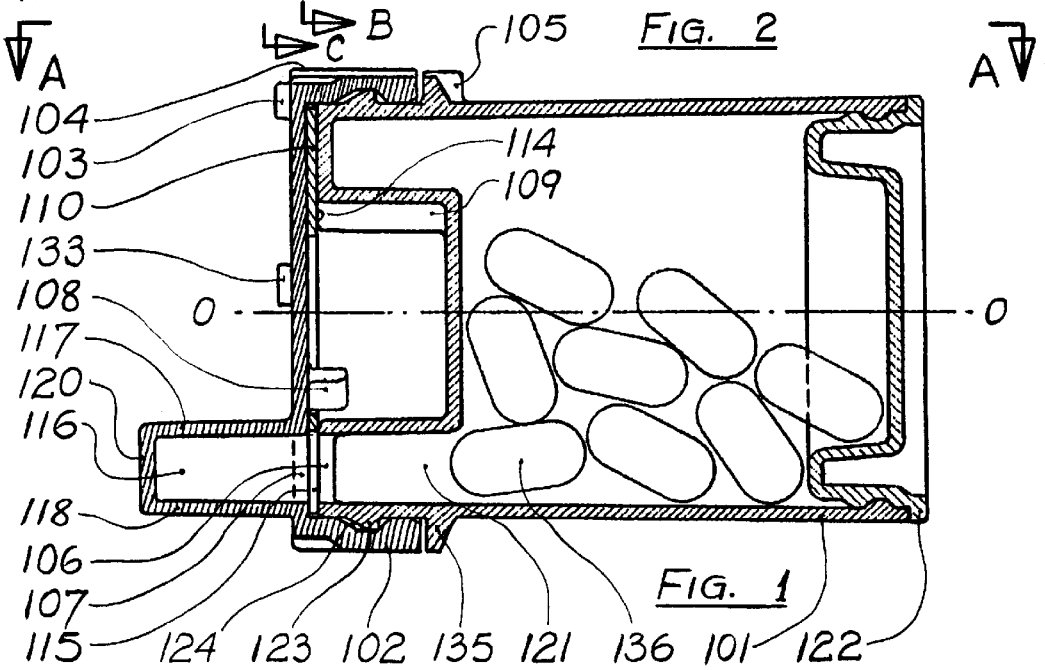
FIG. 1 is a section of the dispensing container, closure, washer and end plug.
Figure 3:
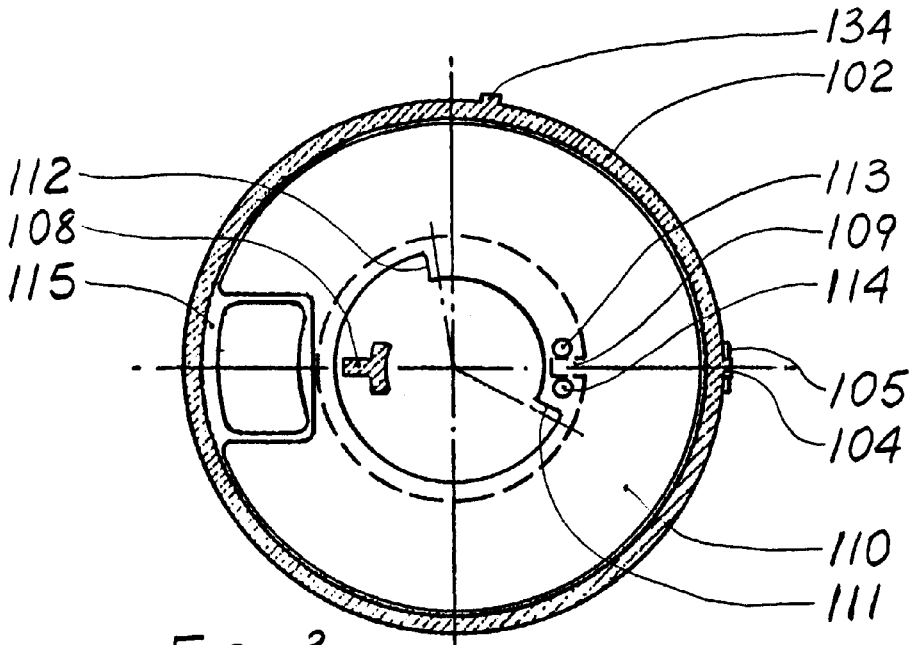
FIG. 3 is the section B—B through the closure in FIG. 2, showing the washer in the first preferred form of this invention, the stops in the closure, the container and the washer and the angular position of two sets of arrows and lines.
Figure 5:
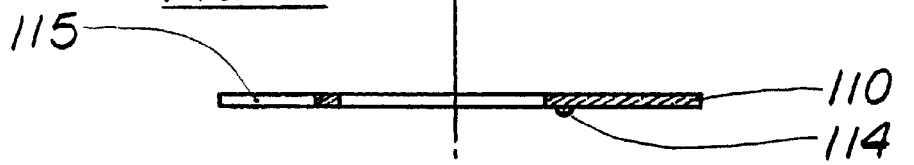
FIG. 5 is a section of the washer in FIG. 3.

Closure 102, said cylindrical end of hollow body 101 and washer 110 have a common axis of rotation 0—0 and said three parts can be rotated and displaced angularly in relation to each other so as to align the apertures 106 and 107 and the cut-out 115 and thereby allow the tablets or other products to pass though them or, alternatively, to misalign one or more of these apertures and thereby seal off the container Inside closure 102 and integral with said closure is stop 108, shown in FIGS. 1 and 3. Inside the base recess of hollow body 101 and integral with said hollow body is stop 109. shown in FIGS. 1 and 3. Washer 110 incorporates positive stops 111 and 112, shown in FIG. 3, that interact with stop 108 in closure 102. Washer 110 also incorporates intermediate stops 113 and 114, shown in FIGS. 3, 5 and 1, which are slightly raised above the surface of said flat washer and interact with stop 109 in hollow body 101 in such a manner that when the closure 102 is turned in relation to hollow body 101, contact between said intermediate stops 113 or 114 with stop 109 will cause washer 110 to retain its angular position with hollow body 101 until such time that the closure's stop 108 pushes positive stop 111 or 112 and thereby causes intermediate stops 113 or 114 to jump over the hollow body's stop 109.

Figure 2:
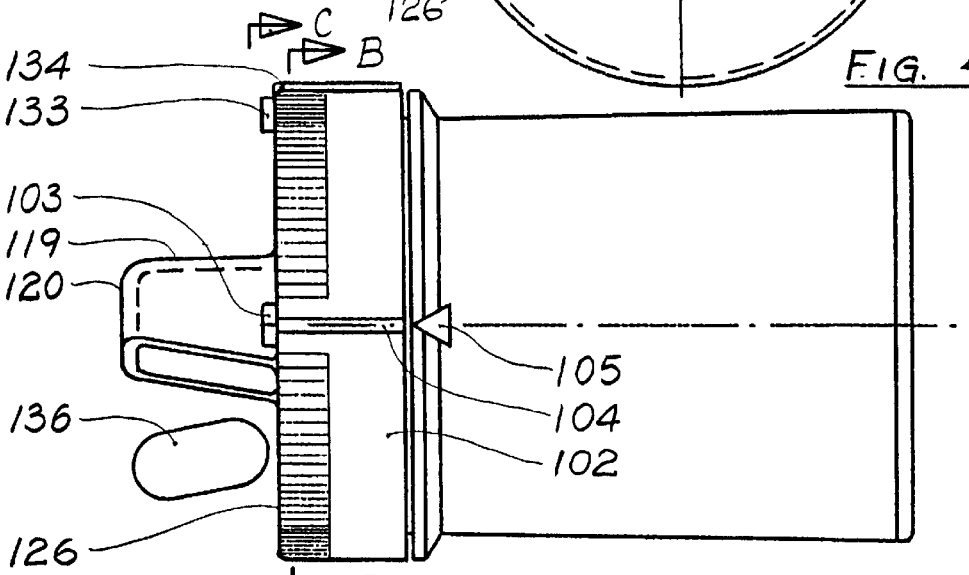
FIG. 2 is the view A—A of the dispensing container and closure in FIG. 1, showing two sets of arrows and lines on the closure.

To align apertures 106 and 107 with each other and with cut-out 115, so that a tablet or other product can pass through them, a predetermined sequence of actions has to take place, as follows:

1. The first action is for the closure 102 to be turned anti-clockwise when viewed in direction of arrows B—B in FIG. 1 in relation to hollow body 101, until said closure's stop 108 reaches said hollow body's stop 109. Said closure will turn with it washer 110 after said closure's stop 108 reaches and engages said washer's stop 111 and thereby will cause the intermediate stops 113 and 114 to be pushed over said hollow body's stop 109.
2. The second action Is for the closure 102 to be turned clockwise in relation to the hollow body 101 until said closure's arrow 133 and line 134 are lined up with said hollow body's arrow 105, as shown in FIGS. 2 and 4. Said closure will turn with it the washer 110 after said closure's stop 108 reaches and engages said washer's stop 112 and thereby will cause said washer's intermediate stop 114 to be pushed over the hollow body's stop 109 and the washer's cut-out 115 will align with the hollow body's aperture 106. The hollow body's stop 109 will thus be located between the washer's two intermediate stops 113 and 114 and this will cause said washer to remain in a fixed angular relationship with said hollow body during the third action.
3. The third action is for the closure 102 to be turned anti-clockwise in relation to the hollow body 101 until the closure's arrow 103 and line 104 are lined Up with the hollow body's arrow 105. This will align the closure's aperture 107 with the hollow body's aperture 106 and the washer's cut-out 115 and, with all three being aligned, the product can now be dispensed by inverting the dispensing container and allowing the product to drop through the aperture.
4. After dispensing the product, the closure 102 is turned clockwise in relation to the hollow body 101 until the closure's stop 108 reaches the hollow body's stop log, thus misaligning the apertures and rendering the dispensing container resistant to children.

As shown in FIGS. 1, 2 and 4, formed around the closure's aperture 107 and integral with said closure is an external receptacle 116, consisting of an outer wall 113, inner wall 117, end wall 119 and top wall 120. A product, such as a round tablet 147 or capsule 136, dropping though the aperture 107 will be arrested in said receptacle and thereby block the way for another such product to drop through said aperture until such time that said product has been removed from said receptacle.

The closure 102 incorporates serrations 137 on the outer surface to facilitate gripping and turning by hand.

The surfaces of the edges of the receptacle walls 117, 118 and 120 lie in one plane 125, shown in FIG. 4. Said surfaces in said plane 125 and part of the adjacent surface 126 of the top of closure 102 can be heat sealed with a single peelable aluminum foil to protect the contents from humidity and contamination during storage and transport. Said aluminum foil is peeled off by the consumer before the product is dispensed.

The product is filled into the hollow body 101 through its open end and said plug 122 is pressed in. The tight press fit of said plug and the rotatable friction fit of the closure 102 with the hollow body 101 protect the contents from moisture ingress.

Said permanent closure 102, said press fitted plug 122 and said heat sealed peelable aluminum foil provide visual evidence should the dispensing container be tampered with.

Figure 6:
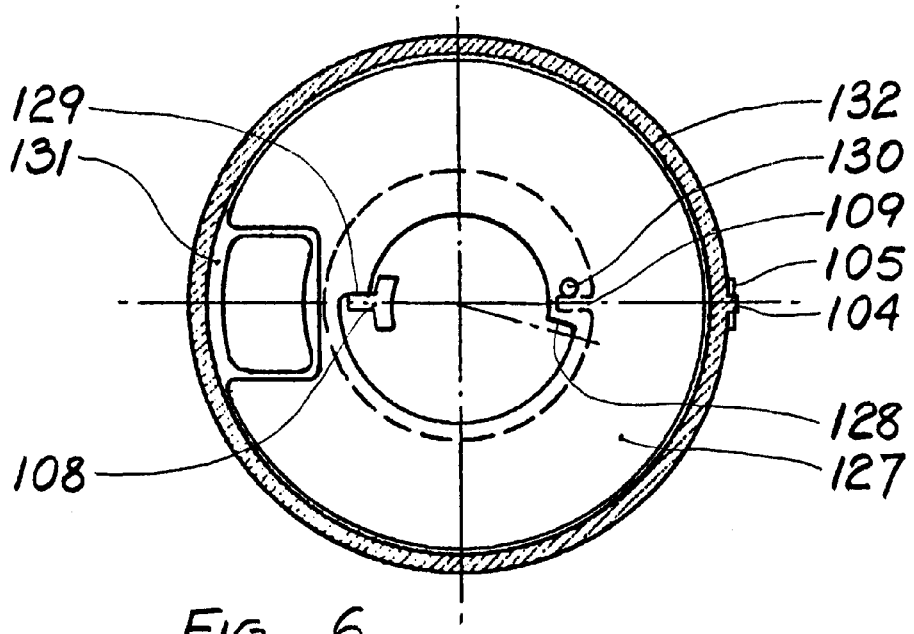
FIG. 6 is the section B—B through the closure in FIG. 2, showing the washer in the second preferred form of this invention, the stops in the closure, the container and the washer and the angular position of one set of arrow and line.
Figure 9:
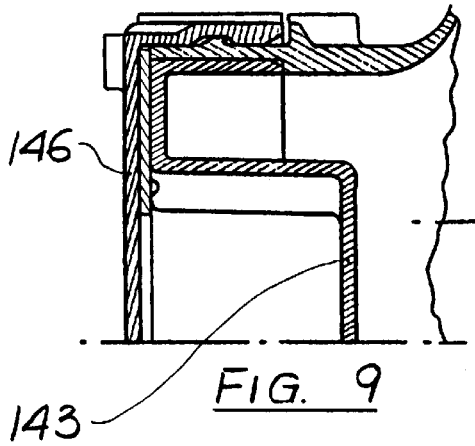
FIG. 9 is an enlarged section of the bottle neck, closure, washer and neck insert in FIG. 7.
Figure 10:
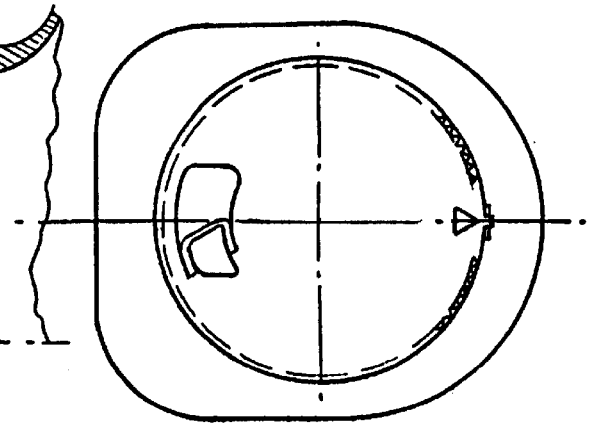
FIG. 10 is the view E—E of the closure and bottle in FIG. 8.
Figure 8:
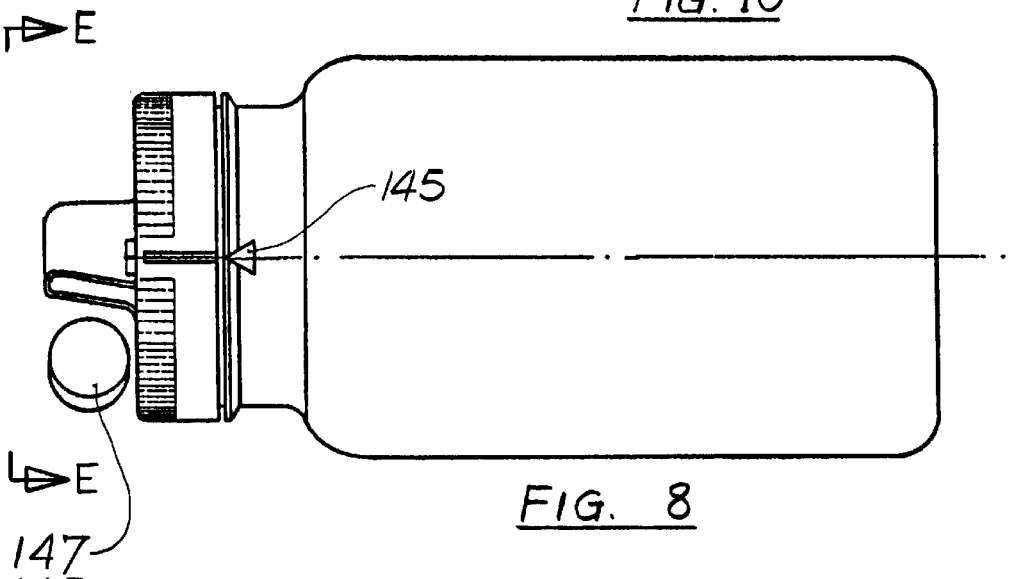
FIG. 8 is the view D—D of the bottle and closure in FIG. 7, showing one set of arrow and line.
Figure 7:
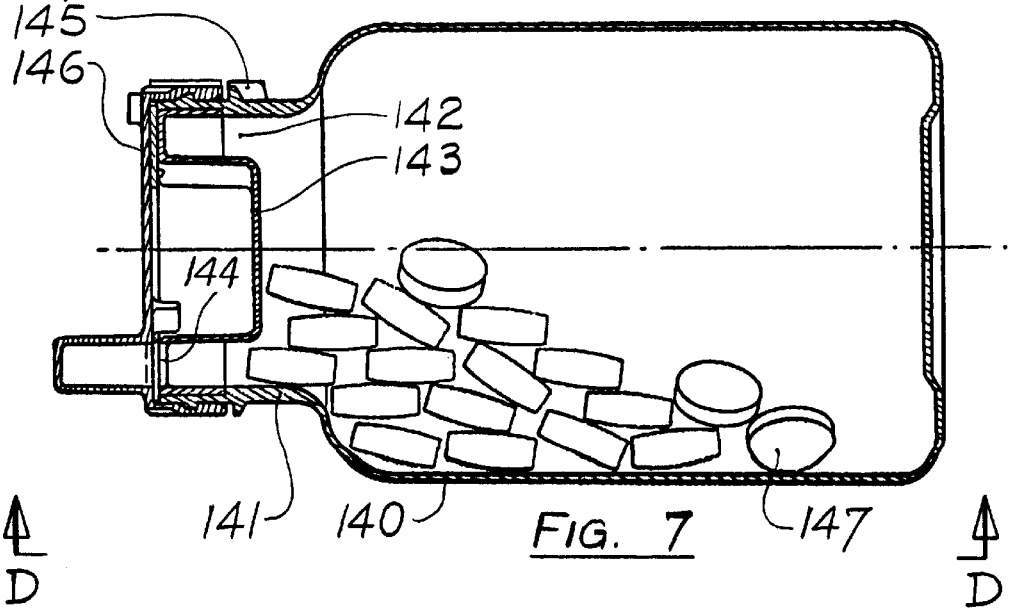
FIG. 7 is a section of a bottle, closure, washer and neck insert of the third preferred form of this invention.
Figure 13:
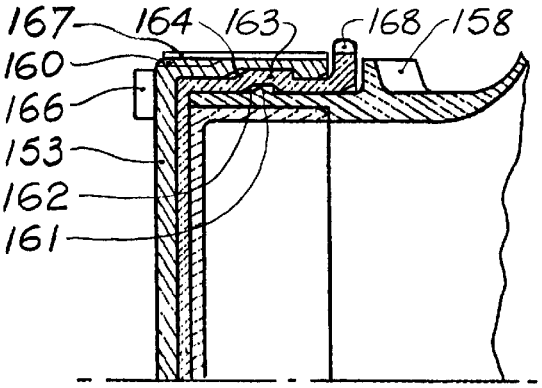
FIG. 13 is an enlarged section of the bottle neck, closure, sleeve and neck insert shown in FIG. 12.

The second preferred form of this invention incorporates the washer 127 shown in FIG. 6 instead of said washer 110 and the closure 132 instead of said closure 102. The closure 132 has only one arrow 103 and line 104. The second arrow 133 and line 134 have been deleted. All other parts of the dispensing container remain the same as in the first preferred form of this invention.

To align the hollow body's and closure's apertures 106 and 107 with each other and with the washer's cut-out 131, so as to enable the tablet or other product to pass through, the following predetermined sequence of actions has to take place:

1. The first action is for closure 132 to be turned anti-clockwise, when viewed in the direction of arrows B—B in FIG. 1, in relation to hollow body 101 until said closure's stop 10 reaches the hollow body's stop 109. Said closure will turn with it washer 127 after said closure's stop 108 reaches and engages said washer's stop 128 and thereby will cause the intermediate stop 130 to be pushed over the hollow body's stop log and align the washer's cut-out 131 with the hollow body's aperture 106.
2. The second action is for closure 132 to be turned clockwise in relation to hollow body 101 until the closure's arrow 103 and line 104 are lined up with the hollow body's arrow 105. This will align the closure aperture 107 with the hollow body's aperture 108 and the washer's cut-out 131 and, with all three being aligned, the product can now be dispensed by inverting the dispensing container and allowing the product to drop through the aperture.
3. After dispensing the product, the closure 132 is turned clockwise in relation to the hollow body 101 until the closure's stop 108 reaches the 10 hollow body's stop 109, thus misaligning the apertures and rendering the dispensing container resistant to children.

The full scope of this invention is not limited to the two preferred forms described above. Other interacting positive and intermediate stops incorporated in the closure, washer and hollow body can be employed to achieve the requirement of a predetermined sequential turning of the closure clockwise and anti-clockwise in relation to the hollow body in order to align all the apertures and cut-out to access the contents, with the objective of making the dispensing container resistant to access by small children when said apertures are misaligned.

FIGS. 7, 8, 9 and 10 show a third preferred form of this invention which is similar to the first and second forms of this invention, incorporating either said washer 110 and said two sets of arrows and lines 103, 104 and 133, 134 or, alternatively, incorporating said washer 127 and only one set of arrow and line 103, 104, however, instead of said hollow body 101 and said plug 122 it uses a bottle 140 with its body narrowing towards the top and forming a neck 141 that is smaller than said body and a fixed neck insert 143. An annular circumferential channel 142 is formed between said neck 141 and said neck insert 143. Said insert 143 incorporates a dispensing aperture 144 which is angularly aligned with an arrow 145 located on said neck of the bottle, said angular alignment being achieved during the assembly of said insert 143 into said neck 141.

FIGS. 11, 12, 13 and 14 show a fourth preferred form of this invention which also consists in a bottle or hollow body and three parts with a common axis of rotation 00—00 and with an aperture in each one of said three parts which have to be lined up angularly by turning said three parts in relation to each other in a predetermined sequence for the contents to be dispensed.

The insert 151 incorporates an aperture 155 and is located inside the cylindrical bottle neck 150 in a fixed angular relationship to the arrow 158 which is incorporated outside said bottle neck. A plastic sleeve 152 is rotatably fixed outside said bottle neck 150 and incorporates an aperture 156. A plastic closure 153 is rotatably fixed outside said sleeve 152 and incorporates an aperture 157. Said apertures 155, 156 and 157 can be aligned by first turning the closure 153 in relation to the sleeve 152 and then turning the sleeve 152 together with the closure 153 in relation to the bottle neck 150 and insert 151. If, however, said apertures 155 and 155 ale aligned first by turning the sleeve 152 in relation to the bottle 150 and only then the closure 153 is turned for alignment of its aperture 157, then the sleeve 152 will tend to follow the closure 153 due to the frictional forces between the two parts and thereby become misaligned with said bottle neck 150 and insert 151. Consequently, the correct sequence of aligning said apertures should be observed.

The sleeve 152 incorporates serrations 159 on its protruding rim, to facilitate gripping and turning by hand. The closure 153 incorporates serrations 160 on the outer surface to facilitate gripping and turning by hand.

The bottle neck 150 has an integral ring 11 that fits into an annular groove 162 in the sleeve 152 and prevents said sleeve from being removed without the use of tools and therefore impossible to remove for small children. Similarly, the sleeve 152 has an integral ring 163 which fits into the annular groove 164 in closure 153 and prevents said closure from being removed without the use of tools.

Incorporated on the outside of closure 153 is arrow 166 and line 167. Incorporated on the outside of sleeve 152 is line 168. When said arrows and lines are lined up by sight or touch with the arrow 158 on the bottle neck 150, the three dispensing apertures are also lined up and the product can be dispensed by inverting the bottle.

Figure 14:
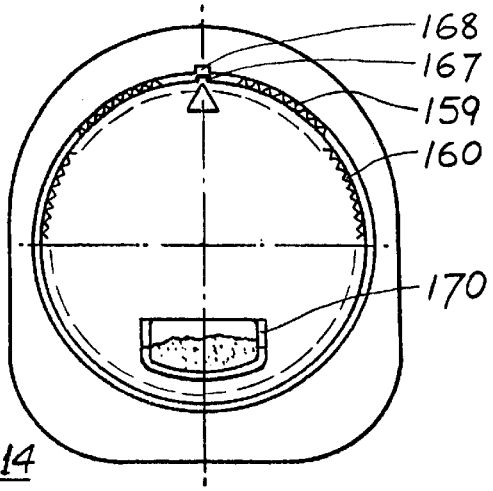
FIG. 14 is the view G—G of the closure and bottle in FIG. 12.
Figure 12:
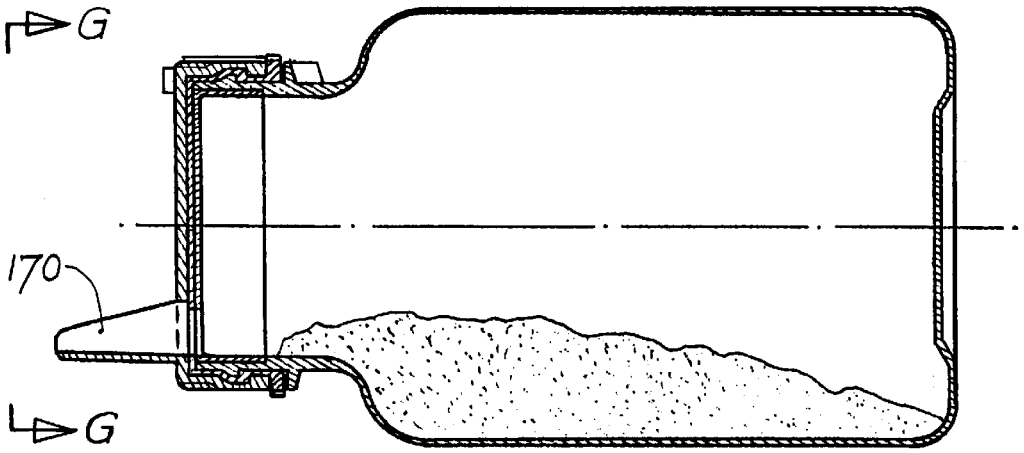
FIG. 12 is a section of a bottle, closure, sleeve and neck insert of the fourth preferred form of this invention when used for dispensing powders and liquids.
Figure 11:
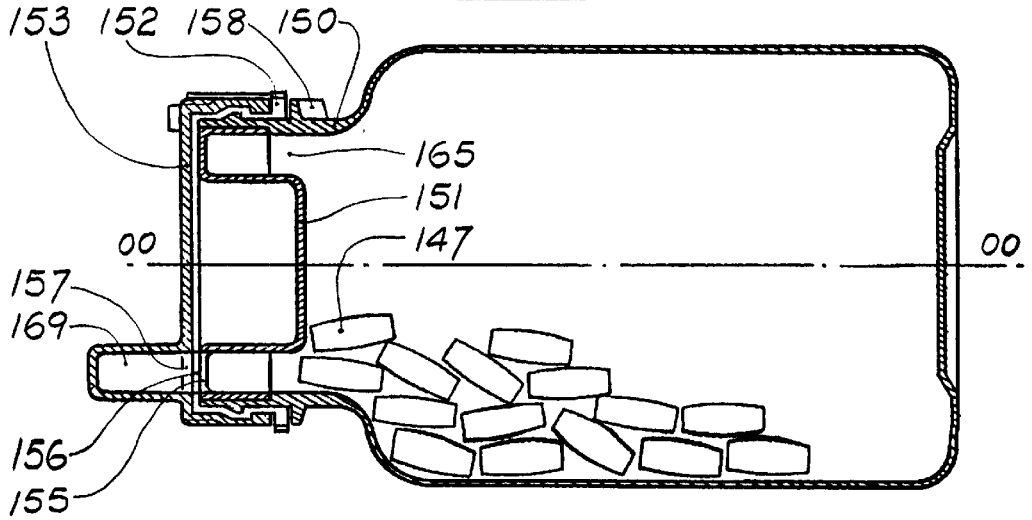
FIG. 11 is a section of a bottle, closure, sleeve and neck insert of the fourth preferred form of this invention when used for dispensing tablets and capsules.

Incorporated into closure 153 is either an external receptacle 169 shown in FIG. 11 for products such as tablets 147 or capsules 136, similar to receptacle 116 described in the first and second preferred forms of this invention or, alternatively, a pouring spout 170 for granular, powder or liquid products shown in FIGS. 12 and 14. Another alternative is to have neither a receptacle nor a pouring spout.

The same sleeve 152 and closure 153 can be used in conjunction with a hollow body instead of a bottle, similar to the hollow body 101 described in the first preferred form of this invention. In this case the annular circumferential channel 165 and aperture 155 are incorporated integrally in the base of said hollow body, as described in the first preferred form of this invention, thus eliminating the separate insert 151, and a plug is added at the other end of the hollow body, similar to plug 122 described in the first preferred form of this invention.

The abovementioned preferred forms of the invention show plastic moldings as the material and method of manufacture, however, other materials such as glass, metal or fibreboard can be used to manufacture the hollow body, and metal can be used to manufacture the closure, plug and neck insert.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A dispensing container having a hollow body to store product and a dispensing port that is selectively opened to dispense product from the hollow body; the dispensing port including first, second and third apertured plates, the first plate being furthest from the hollow body, the three plates being moveable relative to each other to open the port when the apertures of the three plates are aligned, and otherwise to close the port; and there being first formations cooperable between the first and second apertured plates to allow movement of the first plate relative to the second plate within a predetermined range and to constrain the second plate to move with the first plate when the first plate is moved outside of the predetermined range.

2. A dispensing container as claimed in claim 1, wherein second formations are cooperable between the second plate and the third plate to allow the second plate to move freely relative to the third plate when disengaged, and to prevent movement between the second and third plates during movement of the first plate within the predetermined range, when second formations are engaged; the second formations being engaged and disengaged by constrained movement of the second plate relative to the third plate caused by movement of the first plate.

3. A dispensing container as claimed in claim 2, wherein the third plate is fixed relative to the hollow body, the first plate is a closure that is captive and moveable relative to the hollow body, and the second plate is a washer that is trapped between the closure and the third plate.

4. A dispensing container as claimed in claim 3, wherein the closure is rotatable relative to the hollow body.

5. A dispensing container as claimed in claim 1, wherein the first formations include a stop of the closure and two stops of the washer.

6. A dispensing container as claimed in claim 2, wherein the second formations include a stop on the second plate and a stop on the third plate.

7. A dispensing container as claimed in claim 2, wherein the second formations include two stops on the second plate and a stop on the third plate.

8. A dispensing container as claimed in claim 2, wherein there are indicia on the outer surfaces of said first plate and the hollow body to indicate their relative angular position.

9. A dispensing container as claimed in claim 1, wherein there are no said formations, and the first and second plates are captive and individually accessible from the outside to enable their manual rotation in relation to each other and the hallow body.

10. A dispensing container as claimed in claim 1, where the dispensing port is opened by movement of the first plate in a first direction relative to the third plate, and then movement of the first plate in the opposite direction.

11. A dispensing container as claimed in claim 1, where the dispensing port is opened by movement of the first plate in a first direction relative to the third plate, then movement of the first plate in the opposite direction, and then movement of the first plate in the first direction.

12. A dispensing container as claimed in claim 2, wherein there is an external receptacle on the exterior of the first plate to receive product dispensed when the dispensing port is opened.

13. A dispensing container as claimed in claim 2, wherein the hollow body has the shape of a bottle.

14. A dispensing container as claimed in claim 2, wherein the hollow body has a substantially cylindrical shape.

* * * * *